US009453397B2

(12) United States Patent
Dowling et al.

(10) Patent No.: US 9,453,397 B2
(45) Date of Patent: Sep. 27, 2016

(54) DUAL BARRIER SIDE POCKET MANDREL WITH GAUGE

(71) Applicant: SCHLUMBERGER TECHNOLOGY CORPORATION, Sugarland, TX (US)

(72) Inventors: Michael Dowling, Stavanger (NO); Niek Dijkstra, Stavanger (NO)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 471 days.

(21) Appl. No.: 13/961,001

(22) Filed: Aug. 7, 2013

(65) Prior Publication Data

US 2014/0041863 A1 Feb. 13, 2014

Related U.S. Application Data

(60) Provisional application No. 61/681,146, filed on Aug. 9, 2012.

(51) Int. Cl.

| | |
|---|---|
| ***E21B 43/12*** | (2006.01) |
| ***E21B 34/06*** | (2006.01) |
| ***E21B 23/03*** | (2006.01) |
| ***E21B 47/01*** | (2012.01) |
| ***E21B 47/06*** | (2012.01) |

(52) U.S. Cl.

CPC ..... *E21B 43/123* (2013.01); *E21B 23/03* (2013.01); *E21B 34/06* (2013.01); *E21B 47/01* (2013.01); *E21B 47/06* (2013.01)

(58) Field of Classification Search

CPC ..... E21B 43/122; E21B 43/123

See application file for complete search history.

(56) References Cited

U.S. PATENT DOCUMENTS

| | | | | |
|---|---|---|---|---|
| 7,228,909 | B2 | 6/2007 | Schmidt et al. | |
| 7,647,975 | B2 | 1/2010 | Messick et al. | |
| 2003/0164240 | A1* | 9/2003 | Vinegar | E21B 17/003 166/372 |
| 2011/0041360 | A1 | 2/2011 | Torrance et al. | |
| 2011/0315401 | A1 | 12/2011 | White et al. | |
| 2012/0292034 | A1 | 11/2012 | Fay | |

OTHER PUBLICATIONS

Search report for the equivalent GB patent application No. 1314239.3 issued on Jan. 24, 2014.

* cited by examiner

*Primary Examiner* — William P Neuder
(74) *Attorney, Agent, or Firm* — Michael Stonebrook

(57) ABSTRACT

A dual barrier side pocket mandrel with gauge includes a gas lift barrier valve mandrel with permanent sensors and at least two pockets for accepting gas lift barrier valves, wherein the pockets are connected via a port. The mandrel also includes a production conduit along a central longitudinal axis. The mandrel is encompassed by a casing on the inside of a well. The permanent sensors can monitor a pressure or a temperature in the casing, production conduit, and port to determine the status of the individual gas lift barrier valves.

20 Claims, 6 Drawing Sheets

DUAL BARRIER SIDE POCKET MANDREL WITH GAUGE

CROSS-REFERENCE TO RELATED APPLICATION

This Application claims priority to U.S. Provisional Patent Application Ser. No. 61/681,146, filed Aug. 9, 2012, which is hereby incorporated by reference in its entirety.

TECHNICAL FIELD

The field of the disclosure relates generally to gas lift barrier valves and associated side pocket mandrels, and more particularly, to a dual gas lift barrier mandrel design with a permanently associated gauge.

BACKGROUND

For purposes of communicating well fluid to a surface of a well, such as an oil or gas well, a well may include production tubing. Often times, to enhance the rate at which fluid is produced through the production tubing, an artificial-lift technique is employed. One such technique involves injecting gas into the production tubing to displace some of the well fluid in the tubing with lighter gas. The displacement of the well fluid with the lighter gas reduces the hydrostatic pressure inside the production tubing and allows reservoir fluids to enter the wellbore at a higher flow rate. The gas to be injected into the production tubing typically is conveyed down hole via an annulus and enters the production tubing through one or more gas lift barrier valves.

The gas lift barrier valves may be in side pocket gas lift mandrels. These mandrels control the communication of gas between the annulus and a central passageway of the production tubing. Each of these gas lift mandrels can have one or more associated gas lift barrier valves for purposes of establishing one way fluid communication from the annulus to the central passageway.

In the past, gas lift barrier assemblies have been prone to leakage. Leakage has previously been measured using permanent gauges, which measure temperature and or pressure and are connected with the mandrel. In an effort to alleviate leakage, a dual-barrier side pocket mandrel, such as the one described in U.S. Patent Appl. Pub. No. 20110315401 has been used. However, this mandrel does not allow temperatures and/or pressures in the gas lift system to be measured in real time through the use of permanent sensors. Thus, in an effort to optimize a gas lift system, there exists a continuing need to both prevent leakage and accurately determine if leakage is occurring through the use of pressure/temperature sensors.

SUMMARY

The following is brief summary of a combination of embodied features and is in no way meant to unduly limit any present or future claims relating to this disclosure.

In an embodiment, the dual barrier side pocket mandrel with gauges assembly includes a dual barrier side pocket mandrel wherein each side pocket contains a gas lift barrier valve and the pockets are in fluid communication with each other. The dual barrier side pocket mandrel additionally includes permanent sensors, where the sensors can measure a pressure or a temperature in the space where the two pockets are in fluid communication with each other.

Measurement of the pressure in this space in comparison to a pressure in the production conduit portion of the dual barrier side pocket mandrel and the casing can be used to monitor individual integrity of the gas lift barrier valves present in the side pockets.

In one embodiment, a method of using the assembly to determine whether the gas lift barrier valves are leaking is contemplated.

BRIEF DESCRIPTION OF THE DRAWINGS

The description references the accompanying figures.

DETAILED DESCRIPTION

Figure 1:
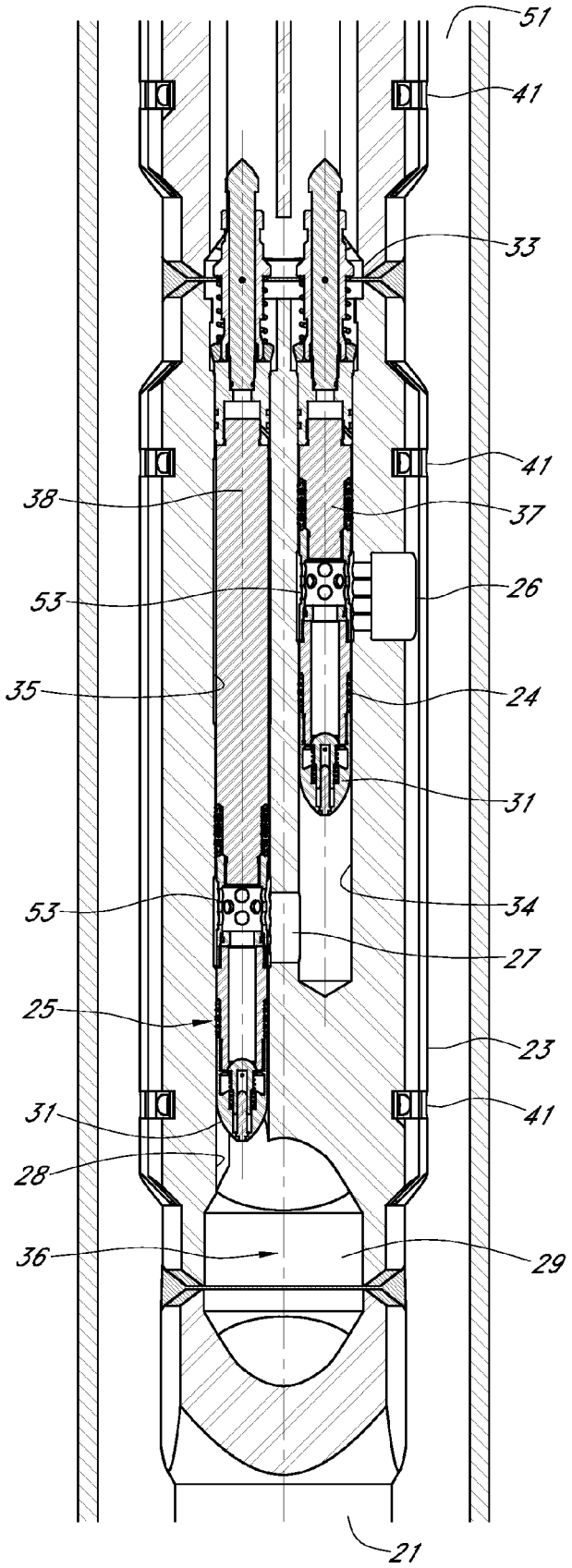
FIG. 1 is a side sectional schematic view of a barrier injection valve side pocket mandrel according to various embodiments.

In the following description, numerous details are set forth to provide an understanding of present embodiments. However, it will be understood by those skilled in the art that the present embodiments may be practiced without many of these details and that numerous variations or modifications from the described embodiments are possible. This detailed description is not meant in any way to unduly limit any present or future claims relating to the present disclosure.

As used here, the terms "above" and "below"; "up" and "down"; "upper" and "lower"; "upwardly", "downwardly"; "up-hole" and "down-hole" and other like terms indicating relative positions above or below a given point or element are used in this description to more clearly describe some embodiments. However, when applied to equipment and methods for use in wells that are deviated or horizontal, such terms may refer to a left to right, right to left, or diagonal relationship as appropriate.

U.S. Patent Publication No. 20110315401, U.S. Pat. No. 7,647,975 and U.S. Pat. No. 7,228,909 discuss various aspects of gas lift barrier valves and associated side pocket mandrels. This literature is incorporated herein by reference in its entirety to provide some background in this area.

An example dual barrier side pocket mandrel with gauges for wells is described. The example barrier mandrel combines a dual barrier gas lift mandrel with permanent sensors, and can be connected to the Earth's surface through a dedicated line, as part of a down-hole instrumentation network, or through other methods known in the art. In an implementation, the example barrier mandrel forms a side pocket mandrel (SPM) which serves multiple purposes by allowing for both real-time barrier integrity monitoring and gas lift optimization by determining the presence of leaks in SPM check valves.

In many embodiments, the SPM is a dual barrier SPM with connected sensors. Herein, the disclosed dual barrier SPM with connected sensors is also referred to as a Barrier Injection Valve SPM. A general dual barrier SPM is described in U.S. Patent Publication No. 20110315401, incorporated by reference in its entirety. A dual barrier SPM enhances capabilities by offering an in-line, redundant, leak-tight seal. In a dual barrier SPM, a configuration of dual bores and communication portals allows the use of two separate and distinct retrievable flow control check valve devices. The two separate and distinct retrievable flow control check valve devices work independently to simultaneously serve both the flow control and pressure barrier requirements.

In one embodiment, the disclosed Barrier Injection Valve SPM can be round-bodied, and fully machined with a solid, e.g., twin 1½" bore pocket design, with a dual-tool discriminator. The first pocket may contain a tubing-to-casing-barrier-valve (TCBV), a type of a gas lift valve, which prevents communication between the tubing and casing when the normal operating gas lift valve is removed from the second (operating) pocket. The second pocket can accept all types of barrier qualified 1½" OD gas lift valves. These types of valves are well known in the art and can be fully barrier qualified and slick-line retrievable.

In an implementation, an example dual barrier mandrel with sensors has the ability to confirm full functionality of each barrier valve independently. For example, a sensor measures the pressure or temperature in the casing, annulus, and/or production tubing and in-between the check valves of the side pockets and determines if either of the dual barrier valves is allowing pressure to leak past them. In an implementation, a hydraulic connection between the Barrier Injection Valve SPM and one or more permanent sensors is utilized to measure the functionality of the barrier valves. However, other known connections, such as a connection where the sensor is directly welded or connections where the sensor is part of the Barrier Injection Valve SPM itself are also contemplated. FIG. 1 demonstrates an embodied Barrier Injection Valve SPM. A Barrier Injection Valve Side Pocket Mandrel 23 is connected with production tubing 21 that is located within a wellbore. The Barrier Injection Valve side pocket mandrel 23 has a production conduit 29 that extends through the middle of the production tubing 21 and the Barrier Injection Valve side pocket mandrel 23. The production conduit 29 has a central axis 36. A first pocket 34 is located in the Barrier Injection Valve side pocket mandrel 23 and is located adjacent to the production conduit 29. The first pocket 34 has a central axis 37. A second pocket 35 is located in the Barrier Injection Valve side pocket mandrel 23 and has a central axis 38. Side pockets 34 and 35 can be cylindrical in shape. Nevertheless, in alternative embodiments, they will be additional shapes, such as oval or rectangular.

A first gas lift barrier valve 24 is located in the first pocket 34. The first gas lift barrier valve 24 forms a seal with the inside of the pocket 34. In many embodiments, the first gas lift barrier valve 24 is a tubing-to-casing-barrier-valve (TCBV). A one-way-check-valve 31 in the gas lift barrier valve 24 allows flow only in one direction. A port 26 connects the outside of the Barrier Injection Valve side pocket mandrel 23 to the inside of the first pocket 34 and the inside of the first gas lift barrier valve 24. Gas can pass through the port 26 and through the one-way-check-valve 31 into a connection port 27. From the connection port 27 the gas can pass into the second pocket 35 and into the second gas lift barrier valve 25. The gas passes through a one-way-check-valve 31 of the second gas list barrier valve 25 and though an opening 28 into the production conduit 29. The second gas lift barrier valve 25 seals with the inside of the second pocket 35. Due to the seals of the first gas lift barrier valve 24 and the second gas lift barrier valve 25, gas traveling along the aforementioned path is prevented from passing into the production conduit 29 by way of openings 33 to each pocket. Each opening 33 connects with either the first pocket 34 or the second pocket 35. The openings 33 are used to place the gas lift barriers into the pockets.

As shown in FIG. 1, the first gas lift barrier 24 is adjacent to the second gas lift barrier 25 and overlaps with the second gas lift barrier in a direction perpendicular to the axis 36. The first gas lift barrier 24 and the second gas lift barrier 25 can be offset in the axial direction. Offset positioning can facilitate flow and connection between the first pocket 34 and the second pocket 35. This embodied configuration allows for gas flow into the port 26, through the gas lift one way check valves and into the production tubing 21. Of course, other variations on this configuration are possible.

In FIG. 1, the example design has various apertures 41 to allow for bypass of control line(s) such as control lines for permanent sensors or other down-hole systems. These control lines are not limiting and can be chemical injection lines, bypass lines, hydraulic lines and the line. In certain embodiments, the apertures 41 shown in FIG. 1 are slots. In the example shown in FIG. 1, there are slots 41 on opposite sides of the perimeter of the Barrier Injection Valve SPM. In one embodiment, the slots are either standard 15×11 mm or 11×11 mm slots. As long as apertures 41 provide space for control lines, the size, number and placement of these slots is not limiting. Bypass is generally for convenience, not necessity. In some embodiments, the Barrier Injection Valve SPM will not contain apertures for control lines. In these embodiments, there may be bypass clamps for control lines or the control lines may otherwise lie outside the Barrier Injection Valve SPM.

Figure 2A:
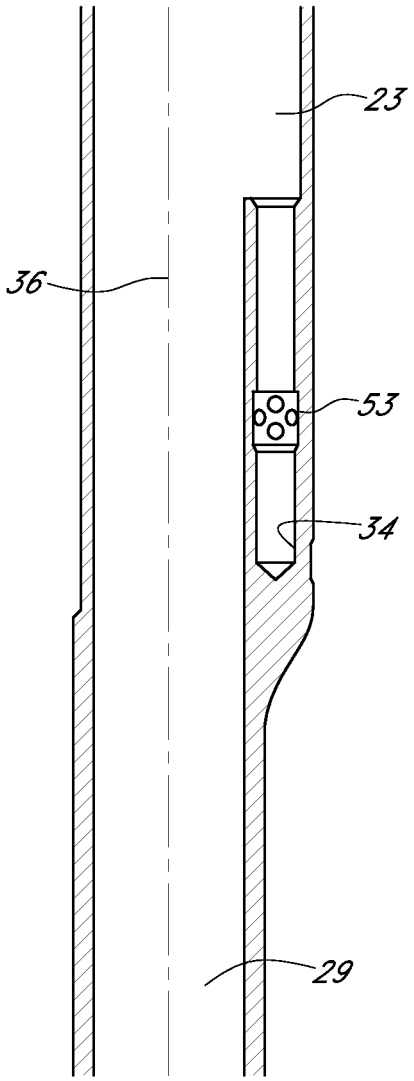
FIGS. 2A and 2B are side sectional schematic views of a barrier injection valve side pocket mandrel according to various embodiments.
Figure 2B:
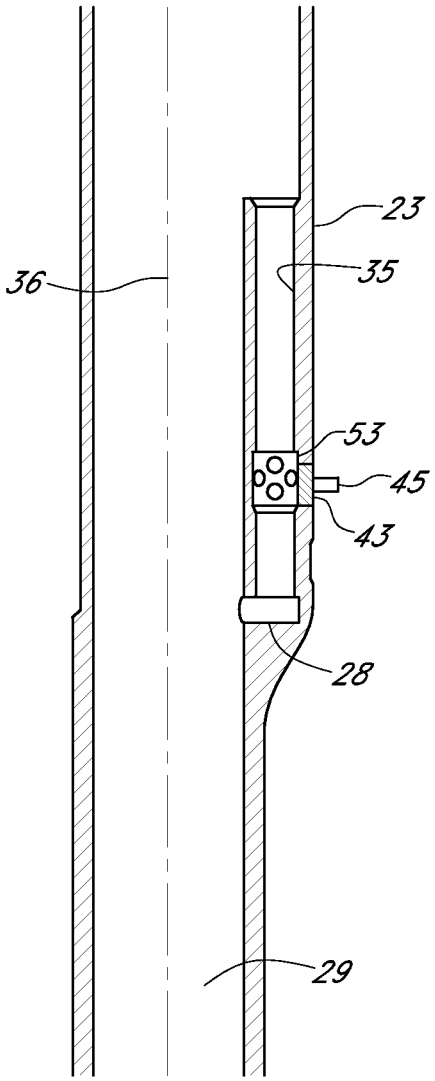
Figure 3A:
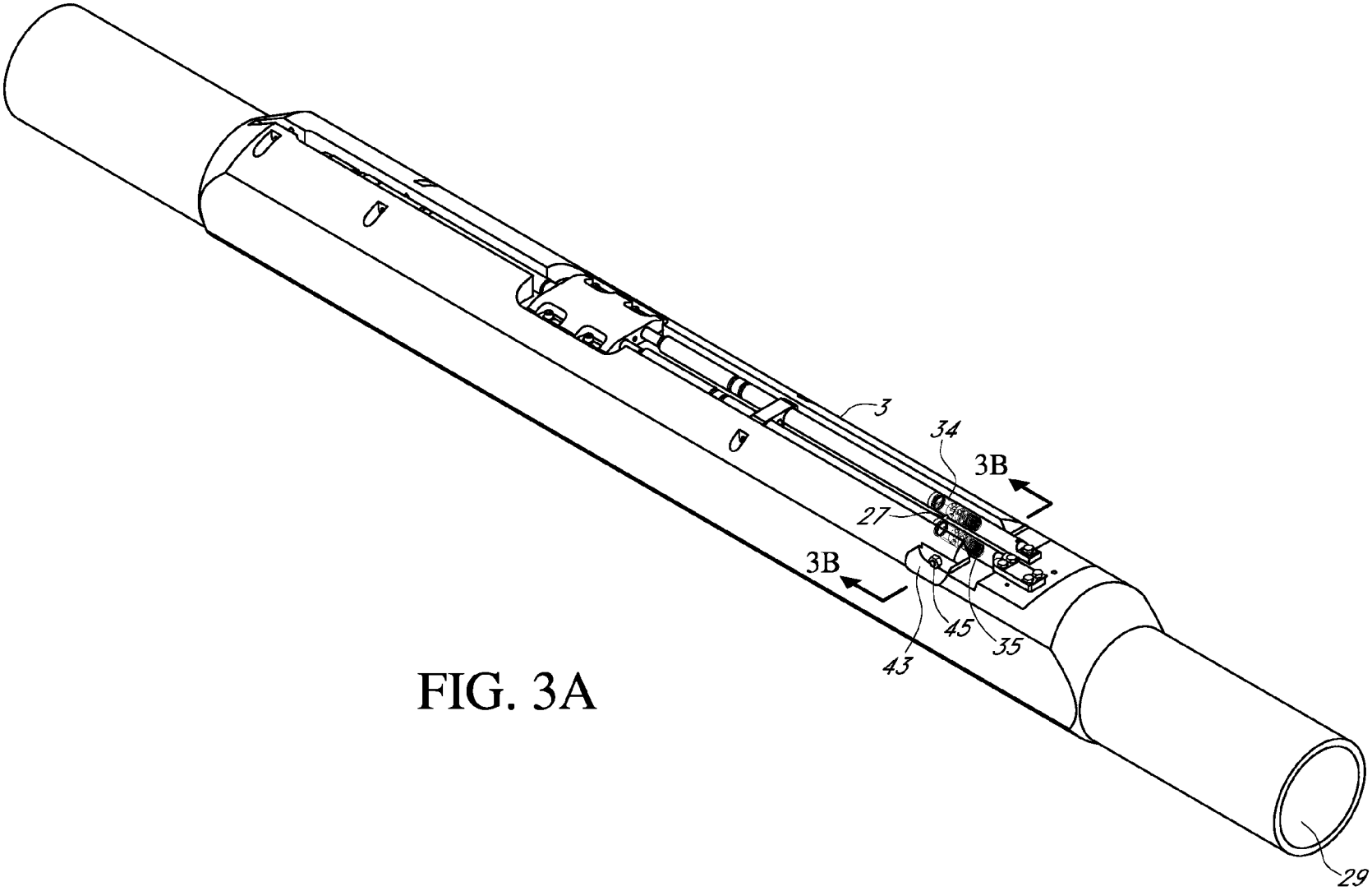
FIG. 3A is a perspective view of an example embodiment.
Figure 3B:
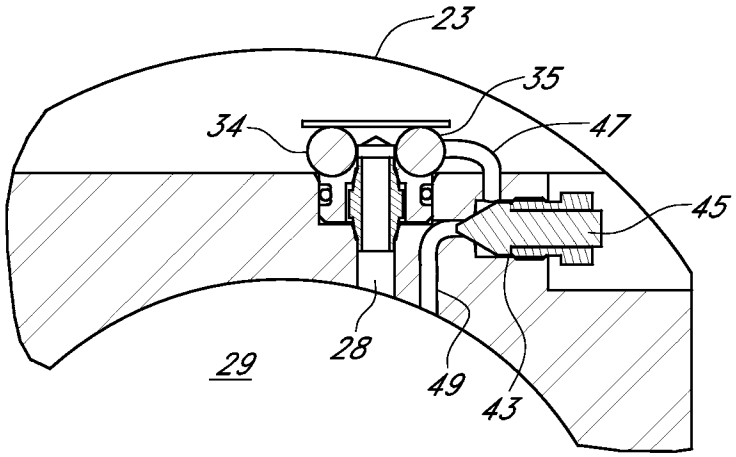
FIG. 3B is a diagram of an embodiment showing a cross-section at a place of measurement by the sensors.

As best seen in FIG. 2B and FIG. 3B, the Barrier Injection Valve SPM contains a sensor profile 43, for placement of permanent sensors. Sensor profile 43 needs to be of a size and shape to accommodate permanent sensors. For example, if triple sensors are attached, sensor profile 43 needs to be large enough to accommodate the triple sensors, which are permanently attached to each other in many embodiments. In the example of FIG. 2B and FIG. 3B, sensor profile 43 is rectangular in shape.

Sensors 45 placed in sensor profile 43 and operably connected with a side pocket are not particularly limiting but in many embodiments, will measure pressure and/or temperature. Generally, these measurements will be in real time. Leak detection of the Barrier Injection Valve SPM may be determined by varying tubing pressure or temperature in production tubing 21 or casing 51. If the tubing pressure or temperature in production tubing 21 down-hole of one way check valve 31 in first pocket 34 but up-hole of second gas lift barrier valve 25 changes, a leak in valve 31 in first pocket 34 should be suspected. If the tubing pressure or temperature in production tubing 21 does not change between the above-measurements but does change down-hole of second gas lift barrier valve 25, this suggests a leak in the Barrier Injection Valve SPM of valve 31 in second pocket 35.

In several embodiments, sensors 45 are gauges. An example sensor is a down-hole pressure sensor, such as a quartz or sapphire gauge. In one embodiment, a sensor may be used as a triple sensor such that the pressure and/or temperature can be measured in production tubing 21, annulus 51, and in port 27. Another contemplated sensor is a temperature sensor.

In one embodiment, there will be more than one sensor 45. In this embodiment, the more than one sensor 45 may be permanently attached to another sensor. For example, sensors 45 may be welded together. However, in other embodiments, sensors 45 may not be grouped together or may be grouped together in a non-permanent configuration. An advantage of permanently attaching sensors 45 to each other, such as through welding, is to eliminate the potential of leaks.

Sensors 45 will additionally be communicatively linked with the Earth's surface, such that their measurements can be monitored. Examples of this communicative link include both hard-wired communication and wireless communication. Hard wired communication can be through the existing tubing such as a dedicated control line, e.g. an electric or fiber optic line sent through the bypass tubing. It is also contemplated that individual communication from the sensors 45 will be multiplexed to down-hole lines in certain embodiments. In these embodiments, there may only be a single line to the surface communicating all of the well's information.

In several embodiments, sensors 45 will further be communicatively linked with a down-hole instrumentation network or additional sensors. Similarly to the communicative link with the Earth's surface, the communicative link with the down-hole instrumentation network may be hardwired and/or wireless.

Sectional side views of the embodied Barrier Injection Valve SPM are shown in FIG. 2A and FIG. 2B. In this example, the mandrel is a 5.5-in. gauge mandrel. Sensor 45 is housed in sensor recess 43 and is operably connected with second pocket 35 of the Barrier Injection Valve SPM. Second pocket 35 is also connected with production conduit 29 through opening 28. In the embodied example, sensor 45 is fitted to the Barrier Injection Valve SPM with a lower radial connector that provides a metal to metal seal. In additional embodiments, sensor 45 is fitted to the Barrier Injection Valve SPM with a HDMC connection pack or welded connection.

FIG. 3A is an example Barrier Injection Valve SPM 23 with installed sensors 45. FIG. 3B demonstrates a cross-section at a place of measurement by sensors 45. In this example, the sensor profile 43 is shown on the side of second pocket 35. Nevertheless, sensor profile 43 can be placed on the side of either first pocket 34 or the second pocket 35. For example, in another implementation (not shown), sensor profile 43 is placed on the side of the first pocket 34. The sensor profile may be any material suited to the specific well environment where Barrier Injection Valve SPM 23 will be used. An advantage of placing sensor 45 closest to second pocket 35 is that this placement allows for a very easy point of measurement at intermediate pressure port 47, which is below check valve 31. Further, intermediate pressure port 47 does not interfere with barrier valve 24 function. However, there is the disadvantage that sensors 45 may be subject to higher gas flow rate and therefore more wear in embodiments where sensor 45 is placed closest to second pocket 35. FIG. 3B also demonstrates tubing pressure port 49, which provides a port for sensor 45 to measure pressure in production tubing 29 down-hole of valve 31 in second pocket 35. In certain embodiments, the Barrier Injection Valve SPM 23 may also include one or more plate recesses (not shown). The plate recesses, which in several cases are slots, may run along control line apertures and allow plates or other structures to be fitted over the control lines and keep the control lines in place. In one example, the plate recess is on the opposite side of the Barrier Injection Valve SPM 23 from sensor recess 43.

In one embodiment, tubing pressure port 47 and intermediate pressure port 49 are grouped together. Generally, as used herein, "grouped together" means that the measurement by the sensors will be at approximately the same depth in the well. Although not required, an advantage of grouping together the measurement points is that there are generally less leaks, the system is more compact and leak detection takes less time and is easier to test.

Figure 4:
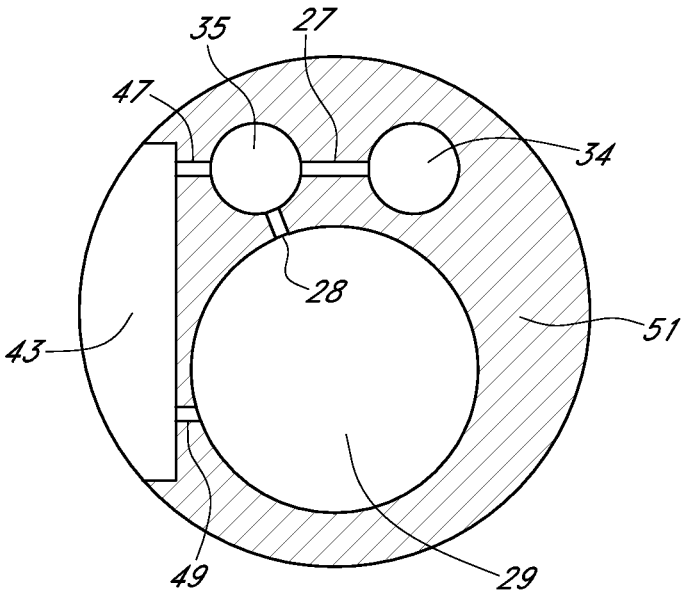
FIG. 4 is a top sectional schematic view of a barrier injection valve side pocket mandrel according to various embodiments.

FIG. 4 shows a sectional top view corresponding to FIGS. 1, 2A and 2B respectively. The first pocket 34 is adjacent and parallel to the second pocket 35. Port 27 connects first pocket 34 to second pocket 35. FIG. 4 also demonstrates sensor recess 43, intermediate pressure port 47 and tubing pressure port 49.

In one implementation, the disclosed device is a single integrated Barrier Injection Valve SPM. This allows a single assembly where external hydraulic piping is not necessary. In other implementations, two or more Barrier Injection Valve SPMs, which will commonly be in communication, with each other will be used.

Individual embodiments may have multiple useful features and functions. For example, in embodiments where sensors monitor the performance of barrier valves in both first side pocket 34 and second side pocket 35, the disclosed Barrier Injection Valve SPM qualifies as a dual barrier solution. Further, certain embodiments result in time savings by decreasing the need for down-hole assemblies to be made up and run-in-hole (RIH). And yet further, certain embodiments enable real-time monitoring, troubleshooting, and optimization of gas lift systems by providing continuous triple pressure data at the point of injection.

Many embodiments will be used, and provide usefulness, in tough well environments and when regulatory pressures demand increased well integrity. For example, the disclosed embodiments can be used where operating procedures force a well to be shut-in when a leaking gas lift valve has been detected during a well integrity test. The disclosed embodiments can provide an increase in the up-time of wells, while at the same time maximizing well potential with real-time optimization. Certain embodiments can be used when there is a requirement for barrier qualified gas lift valves.

Figure 5:
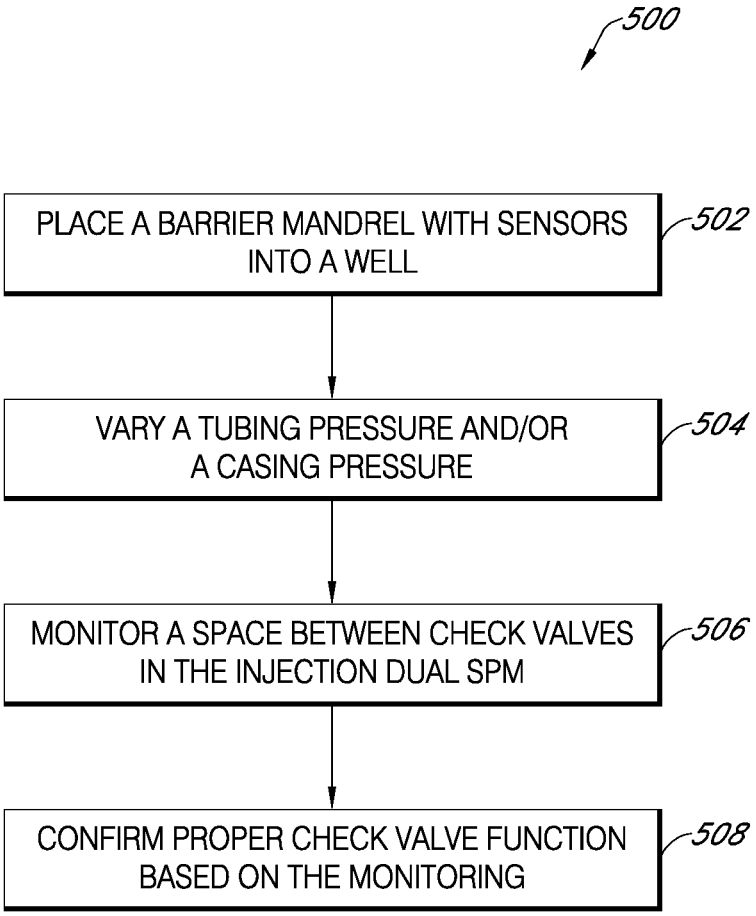
FIG. 5 is a flow diagram of an example method of using the disclosed embodiments.

FIG. 5 shows a flow chart of an example method of using a disclosed embodiment. In the method, the disclosed device is placed in a well 502. In this embodiment, there are typically at least two barrier valves, one in each pocket. The tubing pressure and/or annulus pressure is varied 504, e.g., by an operator who either pumps in gas or releases pressure by opening a choke or through some other method, and a space between the barrier valves in the Barrier Injection Valve SPM is monitored 506 by a permanent sensor. A proper check valve function is confirmed based on the monitoring of the space between the two valves 508. If the particular valve is working the pressures translate and are equal. If there is a differential between the pressures and the pressures are not equal, the valve potentially has a leak and needs to be fixed or replaced. Additional steps in the method, such as repeated iterations, are also contemplated.

From the above discussion, one skilled in the art can ascertain the essential characteristics of the invention, and without departing from the spirit and scope thereof, can make various changes and modifications of the embodiments to adapt to various uses and conditions. Thus, various modifications of the embodiments, in addition to those shown and described herein, will be apparent to those skilled in the art from the foregoing description. Such modifications are also intended to fall within the scope of the appended claims.

What is claimed is:

1. An apparatus, comprising:

a dual barrier side pocket mandrel comprising a production conduit, at least two side pockets, and a port connecting the at least two side pockets, wherein at least one of the at least two side pockets is operatively connected to the production conduit; and a sensor operatively connected with the port and the production conduit, wherein the sensor measures a pressure or a temperature within the port and a pressure or a temperature in the production conduit.

2. The apparatus of claim 1 further comprising a casing, wherein the casing encompasses the dual barrier side pocket mandrel.

3. The apparatus of claim 2, wherein the sensor is operatively connected with the casing and measures a pressure or a temperature within the casing.

4. The apparatus of claim 1, wherein the dual barrier side pocket mandrel comprises a gas lift mandrel.

5. The apparatus of claim 1 wherein the sensor measures in real time one of a temperature or a pressure.

6. The apparatus of claim 1, wherein the sensor comprises a gauge.

7. The apparatus of claim 1, wherein the dual barrier side pocket mandrel is in a well.

8. The apparatus of claim 7, further comprising a communicative link between the sensor and the Earth's surface.

9. The apparatus of claim 7, further comprising a communicative link with a down-hole instrumentation network.

10. The apparatus of claim 1, wherein the at least two side pockets each contain at least one barrier valve; and wherein the sensor confirms a functionality of each barrier valve independently.

11. The apparatus of claim 10, wherein the sensor enables real time barrier integrity monitoring and gas lift optimization by detecting leaks in the at least one barrier valve.

12. The apparatus of claim 1, wherein the sensor is operatively connected to the port via a corresponding hydraulic connection.

13. A method, comprising:

(a) placing a dual barrier mandrel with gauges into a well;

(b) varying a parameter in a tubing conduit;

(c) monitoring a port between at least two barrier valves in the dual barrier mandrel with gauges; and (d) confirming a proper check valve function of at least one of the at least two barrier valves based on the monitoring.

14. The method of claim 13 further comprising varying a parameter in a casing.

15. The method of claim 13 wherein the parameter is a pressure.

16. The method of claim 13 wherein the parameter is a temperature.

17. The method of claim 13 wherein the at least two barrier valves are one-way check valves.

18. The method of claim 13 wherein monitoring determines a difference in the parameter between the production conduit and the port.

19. The method of claim 17 wherein confirming the proper check valve function determines that there is no difference in the parameter.

20. A system comprising:

a well with an internal casing;

a dual barrier side pocket mandrel, wherein the dual barrier side pocket mandrel has at least two side pockets and a production conduit, wherein the at least two side pockets are operatively connected with a port and at least one side pocket is operatively connected with the production conduit; and a sensor, wherein the sensor can measure a parameter in the casing, the port, and the production conduit.

* * * * *